United States Patent [19]

Pardo

[11] 4,196,808

[45] Apr. 8, 1980

[54] CLOSURE INTERLOCK AND PACKAGING APPARATUS

[75] Inventor: John Pardo, Yonkers, N.Y.

[73] Assignee: The Procter & Gamble Company, Cincinnati, Ohio

[21] Appl. No.: 892,235

[22] Filed: Mar. 31, 1978

[51] Int. Cl.[2] ..... B65D 21/02

[52] U.S. Cl. ..... 206/432; 215/6; 220/23.2; 222/129

[58] Field of Search ..... 220/20, 23.2, 23.4, 220/23.8; 215/6, 10, 100 R; 222/129, 543, 546; 206/432, 45.33, 497; 229/DIG. 12

[56] References Cited

U.S. PATENT DOCUMENTS

| | | | |
|---|---|---|---|
| D. 192,980 | 6/1962 | Mangini et al. | 215/6 UX |
| 2,077,977 | 4/1937 | Ahlquist . | |
| 2,896,810 | 7/1959 | Mulvenna | 220/23.4 |
| 2,949,203 | 8/1960 | Berg | 215/6 |
| 2,949,204 | 8/1960 | Edwards | 220/23.4 X |
| 3,145,872 | 8/1964 | Hayes . | |
| 3,404,811 | 10/1968 | Cernei | 215/6 UX |
| 3,741,383 | 6/1973 | Wittwer . | |

*Primary Examiner*—Allen N. Knowles
*Assistant Examiner*—Edward M. Wacyra
*Attorney, Agent, or Firm*—Richard C. Witte; Thomas H. O'Flaherty; John V. Gorman

[57] ABSTRACT

Sequential closure interlock devices for and in combination with dispersing container packages having multiple product compartments provided with parallel neck finishes lying generally in a single plane and separate closure device for each neck finish, especially for use with single use premeasured multiple component products to help ensure opening of the compartments and dispensing of the product components in a proper sequence.

4 Claims, 2 Drawing Figures

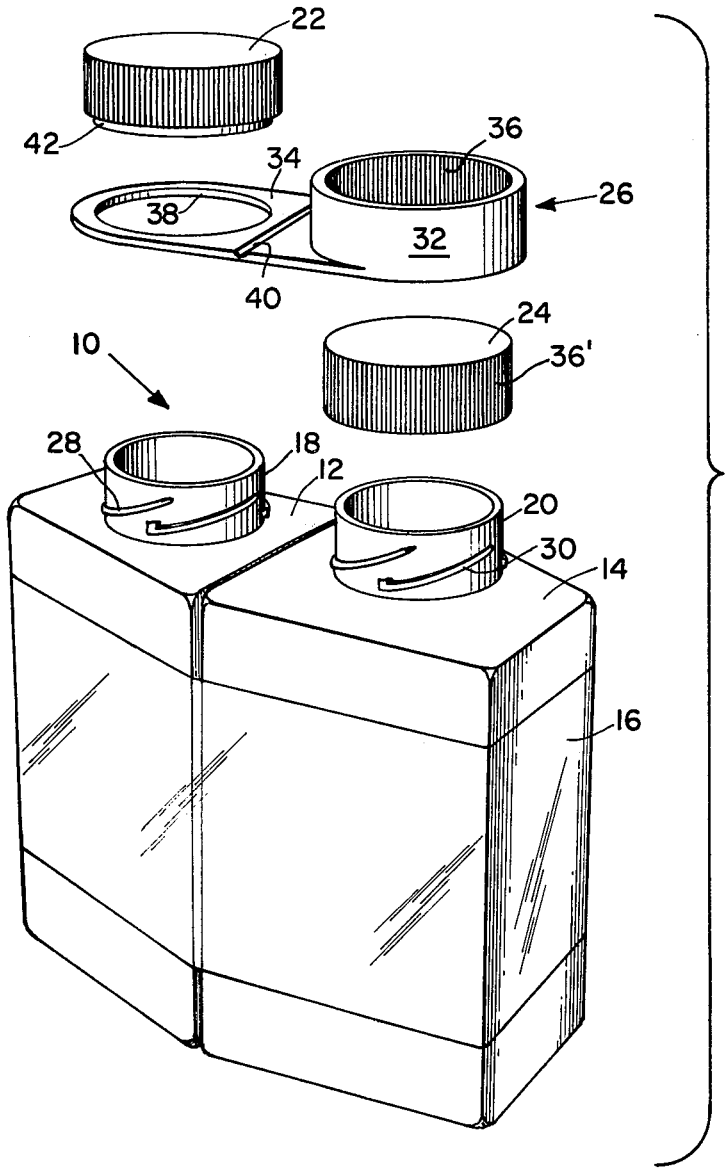
Fig. 1
Fig. 2
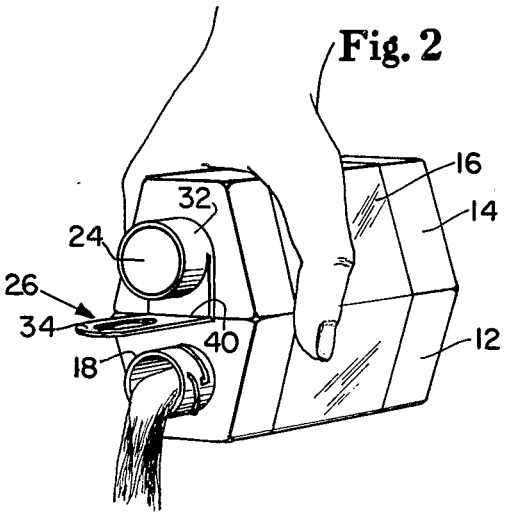

CLOSURE INTERLOCK AND PACKAGING APPARATUS

FIELD OF THE INVENTION

This invention relates to packaging and, more particularly, to methods of and means for preventing opening of a closure device until a related closure device has been opened first and finds particular utility when applied to multiple compartment bottle packages having separate compartments for premeasured single use quantities of multiple component products to help assure that the product components are dispensed in the proper sequence.

BACKGROUND OF THE INVENTION

Many chemical products require that measured quantities of multiple components be dispensed either to be mixed together in sequence, to be used in sequence, or to be added to some solvent or carrier in a given sequence. In some cases the sequence is a preferable sequence and in other cases the sequence is a necessary sequence. For example, where a first component is an activator and a second component is a neutralizer to be utilized after some time period following the use of the activator or first component, it is quite important that the product components be dispensed in the proper sequence.

Such multiple component chemical products can be conveniently packaged as premeasured quantities contained in separate compartments of a unitary package, such as in a plurality of bottles or containers associated together by some binding or packaging arrangement or in separate compartments of a multi-compartmented or partitioned bottle or container. In either instance, each bottle or compartment may be provided with its own dispensing opening and separate closure devices therefor. Prior such packages have left it up to the user to ascertain which is the proper sequence of opening to dispense the product components in the correct order. More preferably, however, it may be desirable to have the package automatically control the sequence within which the closure devices may be opened so that it is difficult for a careless or uninformed user to operate the closure devices and dispense the product components in the incorrect sequence.

OBJECTS OF THE INVENTION

Bearing in mind the foregoing, it is a primary object of the present invention to provide novel methods of and apparatus for automatically aiding in the proper sequential opening of multiple compartment bottle or container packages for multiple component products to help in assuring that the product components are utilized in the proper sequence.

Another primary object of the present invention, in addition to the foregoing, is to provide novel and improved methods of and apparatus for providing a sequential interlock between multiple container closures for adjacent container compartments requiring that the closure be opened or removed in a given sequence.

Still another primary object of the present invention, in addition to each of the foregoing, is the provision of novel methods of and apparatus for providing a first container closure having a transversely extending tether which may be held in place by a second container closure to preclude the first container closure from being turned prior to removal of the second container closure.

Yet another primary object of the present invention, in addition to the foregoing, is to provide novel methods of and apparatus for enclosing a guarded container closure in a guard device held in position by a related closure device to prevent a user's access to such guarded container closure and consequent opening thereof so long as the guard device is so held in position by such related closure device, and finding utility to provide proper sequential operation of said guarded container closure only following operation of the related container closure and release thereby of the guard device.

The invention resides in the combination, construction, arrangement and disposition of the various component parts and elements incorporated in improved methods of packaging and packaging apparatus constructed in accordance with the principles of this invention and in methods of packaging therewith. The present invention will be better understood and objects and important features other than those specifically enumerated above will become apparent when consideration is given to the following details and description, which when taken in conjunction with the annexed drawing describes, discloses, illustrates and shows certain preferred embodiments or modifications of the present invention and what is presently considered and believed to be the best mode of practicing the principles thereof. Other embodiments or modifications may be suggested to those having the benefit of the teachings herein, and such other embodiments or modifications are intended to be reserved, especially as they fall within the scope and spirit of the subjoined claims.

SUMMARY OF THE INVENTION

In accordance with the present invention a sequential interlock or guard device cooperates with a plurality of closure devices associated with parallel neck finishes lying generally in the same plane and provided on adjoining connected bottles or containers or on multiple compartments of a partitioned bottle. The sequential interlock or guard comprises a first or guard portion that cooperates with and encloses one of the closure devices and guarding it to prevent access to such "guarded" closure device by a user. The sequential interlock or guard device further comprises a tether portion which is structurally associated with the other of the closure device so as to hold the sequential interlock or guard device immobile or fixed until after removal of the other closure device, which removal releases the sequential interlock or guard and enables it to be removed from around the guarded closure device or to be moved or turned therewith. In either event, release of the sequential interlock or guard device by operation or removal of such other closure device frees the guarded closure device for opening in its turn.

DESCRIPTION OF THE DRAWING

While the specification concludes with claims particularly pointing out and distinctly claiming the subject matter which is regarded as forming the present invention, it is believed the invention will be better understood from the following detailed description when taken in conjunction with the annexed drawing which discloses, illustrates and shows a preferred embodiment or modification of the present invention and what is presently considered and believed to be the best mode of practicing the principles thereof and wherein:

FIG. 1 is an exploded elevational perspective view of a package constructed in accordance with the present invention; and FIG. 2 is a schematic illustration of the package of FIG. 1 showing a step in its manner or method of use.

DETAILED DESCRIPTION OF THE INVENTION

With reference now to the drawing, there is shown and illustrated a novel and improved package constructed in accordance with the present invention which comprises a unitized package 10 having a plurality of separately accessible compartments for the components of a multiple component product. The unitized package 10 may comprise a plurality, and by way of example a pair of containers 12 and 14 for respectively holding premeasured quantities of separate components of a multiple component product. The unitized package 10 may further comprise means, such as a shrink wrap band 16 joining the containers 12 and 14 into a unified package with the neck finishes 18 and 20, respectively, of the containers or bottles 12 and 14 generally parallel one another and lying generally in the same plane. Rather than separately formed multiple bottles or containers 12 and 14, the present invention also contemplates that the package 10 may be formed of a single multiple compartment or partitioned package having separate neck finishes for the separate compartments. Further, more than two compartments and/or bottles or containers may be utilized and other means other than the shrink wrap band 16 may be utilized to join the bottles or containers into the unified package 10. For example, label panels spanning the joint between the bottles or containers 12 and 14 and bonded to each of the bottles or containers 12 and 14 may be utilized, as may direct bonding of the bottles or containers 12 and 14 to each other. Other types of bands or outer packages or wraps may also be similarly utilized.

As heretofore pointed out, the present invention finds particular utility when applied to single use packaging of premeasured quantities of a multiple component product wherein the premeasured quantities should be dispensed in a given sequence. For example, a premeasured quantity of a product component "alpha" may be prepackaged in the container 12 and a second premeasured quantity of a second product component "beta" may be prepackaged in a bottle or compartment 14, with the contraints of the product use sequence being that product component "alpha" should be dispensed before dispensing of the product component "beta". In accordance with the present invention, in order to control the dispensing sequence, a separate closure device 22 and 24 are respectively associated with each of the neck finishes 18 and 20 of the bottles or containers 12 and 14 and means, such as an interlock or guard device 26, are provided for guarding or protecting the closure device 24, which thereby becomes a guarded closure device. This assures that the guarded closure device 24 cannot be opened or removed until subsequent the opening or removal of the free or independent closure device 22 which has no restriction on its accessibility to the user.

As shown, the closure devices 22 and 24 are screw caps provided with internal threads or thread segments to mate with thread segments 28 and 30 provided, respectively, on the neck finishes 18 and 20. Child resistant caps may be used on either or both the neck finishes 18 and 20, as may be determined by the nature of the product components being packaged.

The interlock guard means or device 26, as heretofore pointed out, serves to restrict access to and thereby guard the closure device 24 against inadvertent opening until subsequent opening of the closure device 22. While only a two component package is shown, it will be obvious from the disclosure hereof, that additional component compartments and closures may also, within the pervue of the present invention be either guarded or guarding. For example, the guard device may be associated with two or more guarding closures so that they must all be removed before the guarded closure can be opened. Similarly, several guard devices, each guarding a guarded closure may be associated with a single free or independent closure so that opening of that closure releases each of the respective guarded closures. Closures and guards may even be serially arranged, i.e., a guarded closure in turn guarding a third guarded closure. Other permutations and combinations will be readily apparent in the light hereof. The interlock or guard device 26 may comprise two portions, a guard portion 32 at one end thereof defining means for structural association with the guarded closure device 24 to access thereto by a user preclude inadvertent opening thereof and a tether portion, projection, or tab 34 extending outwardly therefrom adapted to be held in position by the "guard" closure device 22. So long as so held in place by the cooperation of the guard closure device 22 with the tether portion 34, the guard portion 32 of the guard 26 remains effective to guard the guarded closure device 24 against inadvertent opening. As shown, the guarded closure device 24 and the guard portion 32 may be provided with mating serrations 36 and 36' so that relative rotation therebetween is precluded so long as the guarded closure device 24 is engaged within the guard portion 32. Guard portion 32 may be constructed and arranged to loosely encircle the guarded closure device 24 to preclude inadvertent opening thereof unless and until the guard portion 32 is either removed from its guarding position enclosing the guarded closure 24 or, alternatively, has the tether portion 34 thereof released from its engagement with the neck finish 18 so as to enable the guard portion 32 to be rotated or moved with the guarded closure device 24. The guard portion 32 may alternately be provided with an enlarged smooth bore into which the guarded closure device 24 can fit. This fit can be a slip fit whereat the peripheral surface of the guarded closure device 24 is merely rendered inaccessible to the user and not locked by the guard device 26 against any rotation. Yet further, and guard portion 32 may be jammed or bonded onto the guarded closure device 24 or even formed integrally therewith to positively lock the guarded closure device 24 against any rotation without the guard portion 32 also being rotated. Yet further, the guard portion 32 may be of a cap or inverted cap shaped configuration so as to fully enclose the guarded closure 24.

The tether portion 34 may be provided with an opening or fenestration 38 through which the neck finish 18 of the container 12 may readily pass. The opening or fenestration 38, however, should preferably be smaller than the outside dimensions of the guard closure device 22 so that, when the guard closure device 22 is in its closed position, the tether 34 and, accordingly, the guard device 26 is held positively in place on the neck finish 18 thereby. In addition, if desired, the guard closure device 22 may be provided, adjacent the lower edge thereof, with an annular shoulder 42 for fit within the fenestration 38.

In use, therefore, the interlock or guard device or means 26 precludes the guarded closure device 24 from being opened or removed until subsequent to removal of the guard closure device 22. In use, the guard closure device 22 will be removed first, and the contents of the container or bottle 12 used first, as shown in FIG. 2. As further shown in FIG. 2, after the closure device 22 is removed the tether portion 34 may then be lifted or bent off of the neck finish 18 to release the interlock device 26 therefrom. The tether 34 may be provided with a hinge groove 40 between the fenestration 38 and the guard portion 32 to aid in folding the tether portion 32 upwardly. Then, the interlock device 26 and guarded closure device 24 may be rotated to remove the guard enclosure device 24 from the neck finish 20 enabling dispensing of the quantity of the second product component contained within the bottle or container 14. Alternatively, as pointed out hereinabove, following removal of the guard closure 22, the guard or interlock device 26 may be entirely removed from its guarding position surrounding the guarded closure device 24 and then the guarded closure device 24 may be opened and the contents of the bottle or container 14 used.

Other configurations for the tether portion 34 are also possible without departing from the scope of the present invention. For example, the tether portion 34 need not be terminated in a frame completely surrounding the neck finish 18, a mere notch for receiving a periperal portion of the neck finish 18 should suffice. Further, the tether portion 34, rather than being merely foldable around the groove 40 could be breakable thereat. Yet further, the tether portion 34 could be integrally molded with the guarded closure device 24, as desired.

While the invention has been described, disclosed, illustrated and shown in terms of certain embodiments or modifications which it has assumed in practice, such other embodiments or modifications as may be suggested to those having the benefits of the teachings herein are intended to be expressly reserved especially as they fall within the scope and breadth of the claims here appended.

What is claimed is:

1. A package for sequentially dispensing the components of a two component product, comprising:

(A) a first compartment for storing the component to be dispensed first, said first compartment having a neck finish and an unguarded closure adapted to be tightened on said neck finish;

(B) a second compartment for storing the component to be dispensed last, said second compartment having a neck finish and a guarded closure adapted to be tightened on said neck finish;

(C) means to fasten said compartments in juxtaposed relation, with said neck finishes parallel to each other and at the same elevation; and (D) a sequential interlock comprising:

a sleeve-like guard portion within which said guarded closure telescopes thereby restricting access thereto, and a blade-like tether portion which radially projects from the base of said guard portion, said tether portion having an opening through which the neck finish of said first compartment projects, said guard held in place by the base of said unguarded closure bearing against said tether portion when the unguarded closure is tightened, whereby said unguarded closure must be opened to allow said tether and said guard to be removed, said interlock thereby insuring that said unguarded closure will be opened and the component to be dispensed first is available for utilization prior to the time said guarded closure is opened and the component to be dispensed last can be utilized.

2. The package of claim 1 in which the compartments are found within separate containers and the means to fasten the compartments comprises a shrink wrap band adapted to encircle the containers.

3. The package of claim 2 in which said guarded closure and said guard are provided with mating serrations to preclude relative rotation therebetween.

4. The package of claim 3, in which said tether portion is foldable along a hinged groove, midway between said opening and said guard portion, so that an upwardly folded portion of said tether can be used as a handle to aid in removing said guarded closure.

* * * * *